United States Patent [19]

Farina

[11] 4,065,818

[45] Jan. 3, 1978

[54] BOX SPRING CONSTRUCTION

[76] Inventor: Frederick P. Farina, 1985 Peterson Ave., Coquitlam, B.C., Canada, V3K 1M2

[21] Appl. No.: 685,423

[22] Filed: May 11, 1976

[51] Int. Cl.[2] ..... A47C 19/00; F16M 11/16

[52] U.S. Cl. ..... 5/288; 248/188

[58] Field of Search ..... 5/282 R, 288, 292, 310, 5/203, 205, 304, 200 C; 403/205, 231, 313, 752, 753 D; 248/188, 188.1

[56] References Cited

U.S. PATENT DOCUMENTS

| | | | |
|---|---|---|---|
| 129,121 | 7/1872 | Farnham | 5/200 C |
| 501,006 | 7/1893 | Goodwin | 5/288 |
| 574,742 | 1/1897 | Mafera | 5/205 B |
| 3,329,383 | 7/1967 | Pilliod et al. | 403/231 |
| 3,393,887 | 7/1968 | Zackrisson | 248/188 |
| 3,957,239 | 5/1976 | Slaats | 248/188 |

FOREIGN PATENT DOCUMENTS

| | | | |
|---|---|---|---|
| 681,907 | 3/1964 | Canada | 5/310 |

OTHER PUBLICATIONS

"Alternate Corner Block Construction of High Impact Styrene."

*Primary Examiner*—Casmir A. Nunberg
*Attorney, Agent, or Firm*—Larson, Taylor and Hinds

[57] ABSTRACT

A frame for a box spring is constructed of side and end rails with connectors being provided to join the rail ends at the four corners of the rectangular frame. The connectors are of the slip-on type which provide tight-fitting sockets for the rail ends. Diagonal braces are secured to the corners of the frame interconnect the rails and prevent withdrawal of the rail ends from the sockets. Legs which support the box spring are threaded into sleeves carried by the connectors or, alternatively, are supported by the braces.

2 Claims, 5 Drawing Figures

BOX SPRING CONSTRUCTION

Figure 1:
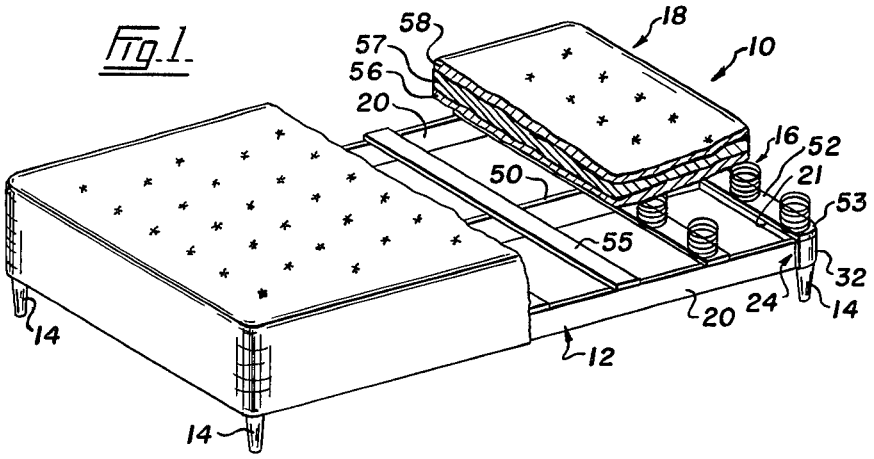

My invention relates to improvements in the construction of box springs intended to support mattresses.

A properly constructed wooden frame of a box spring usually is built by a workman possessing a fairly high degree of carpentry skill and using materials which are of quite good quality. The time required to assemble the frame constitutes a major part of the total construction time for the box spring unit and therefore both labour and material costs are higher than most manufacturers care to accept.

I overcome the above as well as other disadvantages of conventional construction methods by providing unique corner connectors for interconnecting ends of the wooden rails of my box spring frame. The connectors are pre-cast or otherwise formed of a suitable plastic material which will allow them to be mass produced. The rails are cut to length and so are corner braces which are used in the construction, the ends of the corner braces also being bevelled. A semi-skilled workman can then assembly the prefabricated parts quickly and easily to provide an extremely strong, well constructed and relatively inexpensive box spring frame.

More specifically, an assembly according to the present invention may be defined as box spring construction which comprises a rectangular frame having side and end rails, a corner connector for interconnecting adjacent ends of the side and end rails, said corner connector having sockets disposed substantially at right angles to one another, said sockets being defined in part by at least one common vertical web and top and bottom flanges, said vertical web being substantially equal in height to the width of the rails, said top and bottom flanges abutting corresponding edges of the rails and combining with the vertical web to resist downwardly exerted loads on the frame, and locking means retaining adjacent ends of the side and end rails within their sockets.

Figure 2:
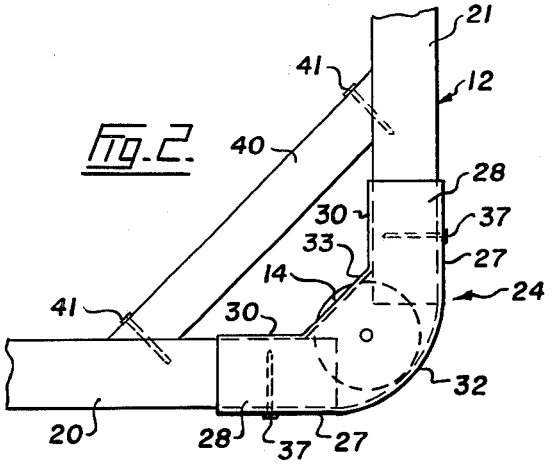
Figure 3:
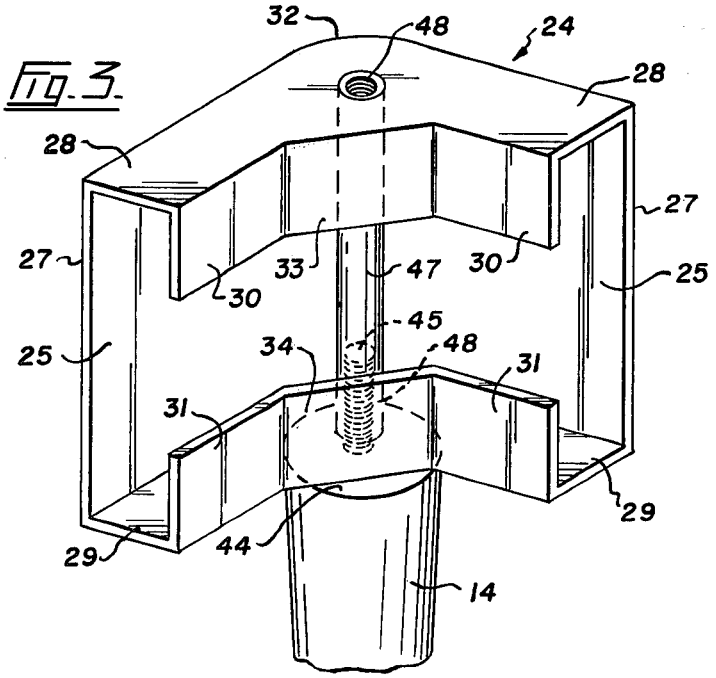
Figure 4:
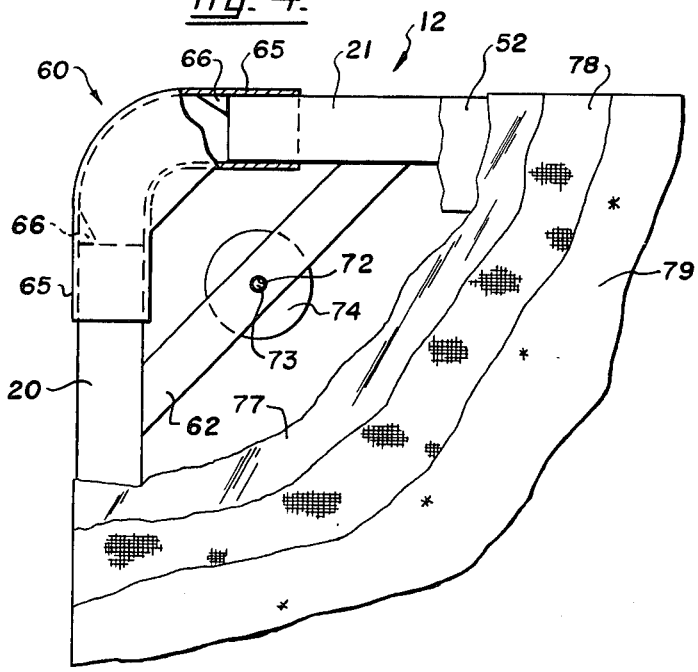
Figure 5:
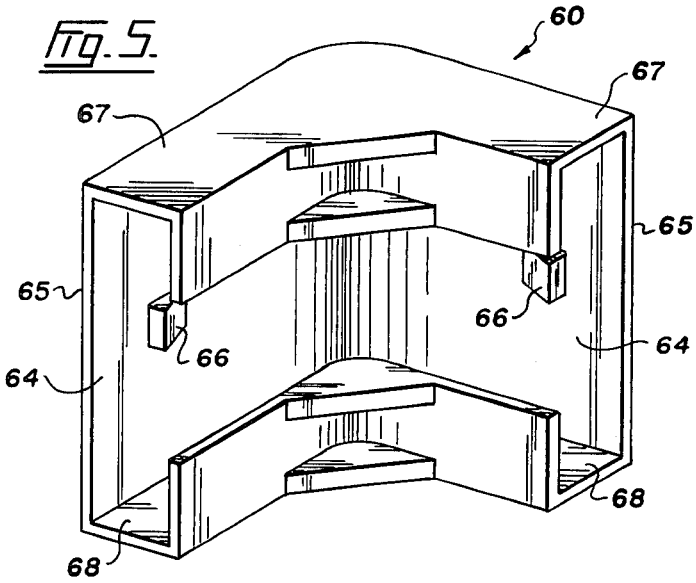

In the drawings which illustrate a preferred embodiment of the invention:

FIG. 1 is a perspective view, partly broken away, showing my box spring construction, FIG. 2 is an enlarged plan view of one corner of a frame used in the box spring construction, FIG. 3 is a perspective view of a corner connector of the box spring construction, FIG. 4 is a fragmentary plan view of one corner of another embodiment of the present invention, and FIG. 5 is a perspective view of corner connector used in this embodiment.

Referring first to FIG. 1 of the drawings, the numeral 10 indicates generally a box spring which embodies the improvements of the present invention. This box spring comprises a rectangular frame 12 which is supported on legs 14. The frame 12 supports a coil spring assembly 16 which is partly enclosed by cover means 18. A box spring of this type, of course, is adapted to support a mattress which has not been illustrated in the drawings.

The frame generally indicated at 12 is shown in FIGS. 1 and 2 to comprise a pair of parallel side rails 20 and similarly disposed end rails 21. These rails I prefer to make of boards some 5 inches wide so as to ensure a particularly rugged and durable box spring frame. At each corner of the frame 12, the rails are interconnected by a connector 24 made of a suitably strong and hard wearing plastic material.

Referring now to FIGS. 2 and 3, a corner connector 24 is shown to comprises a pair of sockets 25 which are disposed at right angles to one another to receive adjacent ends of a side rail 20 and end rail 21. The sockets 25 are defined by an outer web 27, top and bottom flanges 28 and 29, and vertically opposing inner flanges 30 and 31. At the junction of the two sockets, the web 27 is rounded to provide a bend 32. The inner flanges 30 and 31 are bevelled as at 33 and 34 opposite the rounded bend 32.

This particular construction for the corner connectors provides a frame 12 which can be quickly and easily assembled. The ends of the rails are merely thrust into the sockets 25 until they contact the rounded bends 32, see FIG. 2, the bends providing stop means which limit further penetration. The natural tendency of the plastic material is to cling to the wood and this helps to resist withdrawal of the rail ends from the close fitting sockets. It will be noted that the webs 27 are the full height of the rails and that the top and bottom flanges 28 and 29 are in firm contact with the top and bottom edges of the rails. Thus the connectors 24 securing the rail ends as described are capable of supporting any reasonable load placed upon the frame and there is no free play between the interconnected parts which might cause undesirable creaking or movement of the box spring frame. The rail ends may also be secured within their sockets by means of nails 37, see FIG. 2. The nails 37 are driven through the web 27 into the wooden rails to lock the parts together. The same results can be achieved by the use of staples, not shown, instead of the nails 37.

In order to augment the holding action of the nails 37 and to further strengthen the construction generally, I provide the frame 12 with corner braces 40. The diagonal corner braces 40, see FIG. 2, are formed of lengths of wood the same size as the rails and the bevelled ends of these braces are secured to inner faces of the rails by means of nails 41. The several parts of the frame thus far described are firmly locked together once the braces are nailed in place.

The tapered legs 14 which support such a frame are of conventional construction, that is, their upper ends 44 are fitted with a threaded stem 45 as shown best in FIG. 3. Each corner connector is provided with a sleeve 47 to receive such a stem. As shown in FIG. 3, the opposite ends of a sleeve 47 are secured to the top and bottom flanges 28 and 29 of a connector between the center of the rounded bends 32 and the adjacent bevels. Preferably, both ends of the sleeve 47 are internally threaded as at 48 so that the connector can be used either way up. When the stems 45 of the leg are threaded into the lower ends of the sleeves 47 so that the upper faces 44 of the legs are in binding contact with the bottom flange 29, the legs are firmly secured in place and the frame is properly supported.

The rectangular frame 12 is also provided with a longitudinally extending center rail 50 as well as with end slats 52, see FIG. 1. These parts of the frame preferably are made of wood with the rail 50 being of the same dimensions as the rails 20 and 21. The center rail and end slats 52 are suitably nailed to other parts of the frame and the opposite ends of the slats are rounded as at 53 to conform to and vertically align with the rounded bends 32 of the corner connectors.

The space on the top of the frame between the end slats 52 is occupied by other transversely extending slats 55, see FIG. 1. The slats 55 are spaced apart at regular intervals and their center and outer ends are secured to the rails 50 and 20. A sheet of cardboard or other appropriate material (not shown) may be secured to the top of the several transversely extend slats.

The coil spring assembly 16 is secured to the slats or, if the cardboard is used, the assembly is attached to that sheet. In FIG. 1, the coil spring assembly 16 is shown partly enclosed by the cover means 18. Means 18 preferably comprises first an inner sheet 56, next a layer of padding 57, and finally an outer sheet 58. The several parts making up the cover means 18 are secured to one another and to the box frame in a conventional manner and detailed descriptions of the means and methods of constructing this particular portion of the box spring is not considered necessary.

The frame 12 which forms the basis of the present invention will be seen to be constructed in such a way that the parts can be assembled faster and at less cost in terms of material and labor than is the case when conventional box springs are manufactured. In addition, the frame 12 is strong and has greater stability than most box frames for supporting a mattress.

Referring now to the embodiments of the present invention shown by FIGS. 4 and 5 of the drawings; the box spring frame 12 is constructed substantially as previously described or, in other words, it has side and end rails 20 joined together by corner connectors 60 as well as by corner braces 62.

As shown best in FIG. 5, the slightly modified connectors have sockets 64 which are defined in part by an outer web 65. The inner surface of this web is provided with a lug 66 for each socket, the inwardly projecting and integrally formed lug preferably being located midway between top and bottom flanges 67 and 68 of the connector in suitably spaced relation to the open end of the socket. The lugs 66 provide stop means for limiting penetration of the adjacent ends of the side and end rails when those rail ends are thrust into their sockets 64.

The corner braces 62 are provided with vertical openings 72, see FIG. 4. These openings 72, which are located exactly midway between opposite ends of the braces, are intended to receive the stems 73 of legs 74 which support the frame 12.

Frame 12 is provided with the previously described slats including the end slats 52 but the coil spring assembly 16 may be dispensed with in this instance. For example, the slats are covered by a heavy sheet of cardboard 77 as shown in FIG. 4. A layer 78 of cotton or the like is then laid over the cardboard sheet and is suitably secured around its four overlapping sides to the frame. Next an attractive and hard wearing fabric cover 79 is fastened to the frame to cover the layer 78 and this completes the covering of the box spring.

From the foregoing, it will be apparent I provide a strong and easily constructed box spring which can be manufactured at an appreciable saving over conventionally constructed box springs.

I claim:

1. Box spring frame construction comprising a rectangular frame having parallel side rails and parallel end rails, said side and end rails being wooden boards of the same rectangular cross sectional stock, a plastic corner connector for each corner of the rectangular frame, each corner connector having a pair of sockets disposed at right angles to one another for receiving and interconnecting adjacent ends of side and end rails; said pair of sockets of each corner connector being defined by a common vertical web alongside outer surfaces of the side and end rails, top and bottom horizontal flanges alongside upper and lower edges of said side and end rails, and vertically opposed inner flanges alongside inner surfaces of said and end rails; stop means within the pair of sockets of each corner connector for limiting penetration of the side and end rails into said pair of sockets, a diagonal brace secured to the side and end rails near each corner connector, and a plurality of transverse slats interconnecting the side rails including end slats extending over the end rails and portions of the corner connectors.

2. Box spring frame construction as claimed in claim 1, in which said common vertical web of each connector is rounded at the junction of the pair of sockets, and said inner flanges are connected by webs opposite the rounding of the common vertical web.

* * * * *